US009783872B2

(12) United States Patent
Yoshimoto et al.

(10) Patent No.: US 9,783,872 B2
(45) Date of Patent: Oct. 10, 2017

(54) ELECTRODE MATERIAL AND SPARK PLUG

(71) Applicants: NGK SPARK PLUG CO., LTD., Nagoya-shi, Aichi (JP); HITACHI METALS, LTD., Minatu-ku, Tokyo (JP)

(72) Inventors: Osamu Yoshimoto, Inazawa (JP); Tomonori Kanemaru, Nagoya (JP); Takehito Kuno, Nagoya (JP); Tomo-o Tanaka, Kitanagoya (JP); Toshihiro Uehara, Yasugi (JP)

(73) Assignees: NGK SPARK PLUG CO., LTD., Aichi (JP); HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/758,891

(22) PCT Filed: Jan. 8, 2014

(86) PCT No.: PCT/JP2014/050158
§ 371 (c)(1),
(2) Date: Jul. 1, 2015

(87) PCT Pub. No.: WO2014/109335
PCT Pub. Date: Jul. 17, 2014

(65) Prior Publication Data

US 2015/0340844 A1 Nov. 26, 2015

(30) Foreign Application Priority Data

Jan. 8, 2013 (JP) ..... 2013-000885

(51) Int. Cl.
*H01T 13/39* (2006.01)
*C22C 19/05* (2006.01)

(52) U.S. Cl.
CPC ..... *C22C 19/05* (2013.01); *H01T 13/39* (2013.01)

(58) Field of Classification Search
USPC ..... 313/141, 311, 352; 428/619, 680, 446; 420/442, 443, 445, 452, 459; 148/410,
(Continued)

(56) References Cited

U.S. PATENT DOCUMENTS

2007/0159046 A1* 7/2007 Yoshimoto ..... H01T 13/20 313/141
2007/0290591 A1 12/2007 Lykowski et al.
(Continued)

FOREIGN PATENT DOCUMENTS

CN 101501229 A 8/2009
JP 2000-336446 A 12/2000
(Continued)

OTHER PUBLICATIONS

Search Report dated Feb. 10, 2014 issued in International Application No. PCT/JP2014/050158 (PCT/ISA/210).
(Continued)

*Primary Examiner* — Ashok Patel
(74) *Attorney, Agent, or Firm* — Sughrue Mion, PLLC

(57) ABSTRACT

An electrode material for at least one of a center electrode (5) and a ground electrode (27) provided with a chip (31, 32) for use in a spark plug (1). The electrode material contains Ni as a principal component, and has a Si content of from 0.50% to 1.0% by mass, an Al content of from 0.2% to 2.0% by mass, a Cr content of from 12% to 34% by mass, a rare-earth element or the like content of from 0.03% to 0.2% by mass, a Fe content of more than 0% but not more than 20% by mass, a C content of not more than 0.10% by mass, and a Mn content of not more than 1.0% by mass. The total content of Si and Al is not less than 0.80% by mass, and less than one tenth of the Cr content.

10 Claims, 3 Drawing Sheets

(58) Field of Classification Search
USPC ..... 148/427, 428
See application file for complete search history.

(56) References Cited

U.S. PATENT DOCUMENTS

| | | | | |
|---|---|---|---|---|
| 2012/0031529 | A1* | 2/2012 | Ohishi | C21D 6/02 148/318 |
| 2013/0181596 | A1* | 7/2013 | Tanaka | C22C 19/03 313/141 |

FOREIGN PATENT DOCUMENTS

| | | | |
|---|---|---|---|
| JP | 2002-235137 | A | 8/2002 |
| JP | 2002-235139 | A | 8/2002 |
| JP | 2003-138334 | A | 5/2003 |
| JP | 2006-236906 | A | 9/2006 |

OTHER PUBLICATIONS

Written Opinion dated Feb. 10, 2014 issued in International Application No. PCT/JP2014/050158 (PCT/ISA/237).
Office Action dated Jan. 5, 2016, issued by the State Intellectual Property Office of P.R. China in Chinese Application No. 201480004267.6.

* cited by examiner (a)

(b)

ELECTRODE MATERIAL AND SPARK PLUG

CROSS REFERENCE TO RELATED APPLICATIONS

This application is a National Stage of International Application No. PCT/JP2014/050158 filed Jan. 8, 2014, claiming priority based on Japanese Patent Application No. 2013-000885 filed Jan. 8, 2013, the contents of all of which are incorporated herein by reference in their entirety.

TECHNICAL FIELD

The present invention relates to an electrode material for making an electrode of a spark plug, and a spark plug.

BACKGROUND ART

A spark plug for use in an internal combustion engine or the like includes, for example, an insulator having an axial hole extending in the direction of the axial line, a center electrode inserted into the axial hole, a metal shell having a tubular shape and provided on the outer periphery of the insulator, and a ground electrode having a rod shape fixed to the above-described metal shell. In addition, a space is created between the tip end portion of the ground electrode and the tip end portion of the center electrode. Placing a voltage on the space generates spark discharge. In addition, there is known a method for bonding a chip made from a metal with high durability such as a noble metal alloy to a section of the center electrode or the ground electrode that creates the space in order to improve wear resistance to spark discharge.

In addition, proposed is an electrode material for use of a spark plug electrode such as containing 10 to 25% by mass of chromium (Cr), 0.3 to 3.2% by mass of aluminum (Al), 0.2 to 2.2% by mass of silicon (Si), 0.1 to 0.8% by mass of manganese (Mn), less than 0.001% by mass of magnesium (Mg), less than 0.002% by mass of sulfur (S), and the balance being Ni and unavoidable impurities (for example, see Patent Document 1, etc.). This composition can improve high-temperature oxidation resistance while improving workability, and improve wear resistance to spark discharge in the electrode.

CITATION LIST

Patent Literature

Patent Document 1: JP-A-2002-235139

SUMMARY OF THE INVENTION

Problem that the Invention is to Solve

However, in the above-described technique, the bondability of the chip to the electrode can not be ensured sufficiently, which is likely to cause exfoliation (falling) of the chip. Especially in a high power and high compression engine of recent years, the temperature of a combustion chamber is more raised while vibration added to the electrode or chip by movement of the engine is likely to become larger. Thus, there is more concern about exfoliation (falling) of the chip in the engine of this type.

The present invention is made in view of the above problems, and an object of the present invention is to provide an electrode material and a spark plug capable of remarkably improving bondability of a chip to an electrode, avoiding exfoliation of the chip very effectively, and further achieving favorable workability and sulfur resistance in the electrode to which the chip is bonded.

Means for Solving the Problem

Hereinafter, descriptions of configurations appropriate to solve the above-described problems will be provided item by item. It is to be noted that descriptions of effects specific to the corresponding configurations will be additionally provided as necessary.

Configuration 1: An electrode material according to this configuration for an electrode that is provided with a chip and is for use in a spark plug, the spark plug comprising a center electrode and a ground electrode creating a space with the center electrode, the chip being provided to at least one of the electrodes, the electrode material comprising nickel as a principal component, and further including silicon of which content in a range from 0.50% to 1.0% by mass, aluminum of which content in a range from 0.2% to 2.0% by mass, chromium of which content in a range from 12% to 34% by mass, at least one element selected from the group consisting of yttrium and a rare-earth element of which content in a range from 0.03% to 0.2% by mass, iron of which content is more than 0% to 20% by mass, carbon of which content is not more than 0.10% by mass, and manganese of which content is not more than 1.0% by mass, wherein a total content of silicon and aluminum is not less than 0.80% by mass with one tenth or less of the content of chromium.

It is to be noted that the electrode material does not necessarily need to contain C or Mn, and the electrode material may not contain C or Mn.

According to the above-described configuration 1, the electrode material contains 0.50% by mass or more of Si, 0.2% by mass or more of Al, and 12% by mass or more of Cr while the total content of Si and Al is 0.80% by mass or more, and one tenth or less of the content of chromium (% by mass). Thus, in using (under high temperature), a $Cr_2O_3$ film excellent in oxidation resistance is sufficiently formed on an electrode surface, and an $Al_2O_3$ film and an $SiO_2$ film each of which has a favorable oxidation resistance are surely formed immediately beneath the $Cr_2O_3$ film, which allows the $Cr_2O_3$ film to be held stably by both the films (which can suppress exfoliation of the $Cr_2O_3$ film). This configuration combined with the content of 0.03% by mass or more of Y and a rare-earth element can remarkably improve the oxidation resistance of the electrode. As a result, formation of an oxidized scale at a boundary section between the chip and the electrode can be effectively suppressed.

Further, according to the above-described configuration 1, the content of Si is less than 1.0% by mass, which can surely suppress formation of a eutectic structure at a boundary section between the chip and the electrode when platinum (Pt) is contained in the chip or the like.

In addition, because the electrode material contains Fe, degradation of workability due to strength degradation under high temperature can be improved. In addition, the electrode is more likely to deform at high temperature, so that stress resulting from differential thermal expansion between the chip and the electrode can be made easily absorbed by the electrode under high temperature.

In addition, because the content of Al is 2.0% by mass or less while the content of Fe is 20% by mass or less, the above-described effect to improve the oxidation resistance of the electrode can be sufficiently maintained, which can more surely suppress formation of oxidized scale.

As described above, according to the above-described configuration 1, the above-described effects act synergistically, which can remarkably improve bondability of the chip to the electrode. As a result, exfoliation (falling) of the chip can be suppressed very effectively.

Further, according to the above-described configuration 1, because the content of Al is not more than 2.0% by mass while the content of Cr is not more than 34% by mass, solution hardening of the electrode can be more surely prevented. In addition, because the content of Y and the rare-earth element is not more than 0.2% by mass while the content of C is not more than 0.1% by mass, Y, C, and the like can be suppressed from being precipitated under high temperature, which can more surely prevent precipitation hardening of the electrode. As the results, favorable workability can be achieved.

In addition, according to the above-described configuration 1, because the content of Mn is not more than 1.0% by mass, not only formation of MnS but also formation of NiS inside of the electrode can be effectively suppressed. Thus, sulfur resistance of the electrode can be improved combined with the above-described improvement in oxidation resistance of the electrode, corrosion resistance of the electrode can be remarkably improved.

Configuration 2: The electrode material according to the above-described configuration 1, wherein the total content of silicon and aluminum is not less than 1.0% by mass.

According to the above-described configuration 2, because the total content of Si and Al is not less than 1.0% by mass, the $Al_2Os$ film and the $SiO_2$ film ca be further surely formed immediately beneath the $Cr_2O_3$ film. Thus, exfoliation of the $Cr_2O_3$ film can be more effectively suppressed, and formation of an oxidized scale at a boundary section between the chip and the electrode can be further suppressed. As a result, the bondability of the chip can be more improved.

Configuration 3: The electrode material according to the above-described configuration 1 or 2, wherein the content of carbon is not more than 0.05% by mass, and wherein the content of manganese is not more than 0.5% by mass.

According to the above-described configuration 3, because the content of C is not more than 0.05% by mass, C can be more effectively suppressed from being precipitated under high temperature. Thus, the precipitation hardening of the electrode can be prevented further surely, and the workability can be further improved.

In addition, according to the above-described configuration 3, because the content of Mn is not more than 0.5% by mass, the sulfur resistance of the electrode can be further improved. As a result, the corrosion resistance can be further improved.

Configuration 4: The electrode material according to any one of the above-described configurations 1 to 3, wherein the content of chromium is in a range from 18% to 28% by mass.

According to the above-described configuration 4, because the content of Cr is not less than 18% by mass, oxidation resistance of the electrode can be more improved. As a result, formation of an oxidized scale at a boundary section between the chip and the electrode can be further suppressed, and the bondability can be further improved.

In addition, because the content of Cr is not more than 28% by mass, the solution hardening of the electrode can be more surely suppressed, and workability can be further improved.

Configuration 5: The electrode material according to any one of the above-described configurations 1 to 4, wherein the content of aluminum is not more than 1.0% by mass.

According to the above-described configuration 5, because the content of aluminum is not more than 1.0% by mass, AlN can be suppressed more surely from being precipitated. Thus, oxidation resistance of the electrode can be further improved, and the effect to suppress formation of an oxidized scale can be further enhanced.

In addition, because the content of aluminum is not more than 1.0% by mass, the solution hardening of the electrode can be further surely suppressed. As a result, the workability can be further improved.

Configuration 6: The electrode material according to any one of the above-described configurations 1 to 5, wherein the content of yttrium is in a range from 0.05% to 0.15% by mass.

According to the above-described configuration 6, because the content of Y is not less than 0.05% by mass, oxidation resistance of the electrode can be further improved, and thus bondability of the chip can be further improved.

Meanwhile, because the content of Y is not more than 0.15% by mass, Y can be suppressed more surely from being precipitated. Thus, more excellent workability can be achieved.

Configuration 7: The electrode material according to any one of the above-described configurations 1 to 6, wherein the content of iron is in a range from 7% to 15% by mass.

According to the above-described configuration 7, because the content of Fe is not less than 7% by mass, the electrode is more likely to thermally expand, and thus differential thermal expansion between the chip and the electrode can be further decreased. As a result, the bondability can be more effectively improved.

Further, according to the above-described configuration 7, because the content of Fe is not more than 15% by mass, the solution hardening of the electrode can be effectively suppressed, and the workability can be further improved.

Configuration 8: The electrode material according to any one of the above-described configurations 1 to 7, wherein the content of iron is not more than 10% by mass.

According to the above-described configuration 8, because the content of Fe is not more than 10% by mass, hot forging of the electrode can be further improved, and thermal stress between the chip and the electrode can be further decreased. As a result, further excellent bondability can be achieved.

Configuration 9: A spark plug according to this configuration comprises an insulator having a through-hole in a direction of an axial line, a center electrode disposed at a tip end portion of the insulator, a metal shell disposed on an outer periphery of the center electrode, and a ground electrode bonded to a tip end portion of the metal shell, wherein at least one of the center electrode and the ground electrode is made from the electrode material according to any one of claims 1 to 8, and is bonded to a chip.

According to the above-described configuration 9, effects same as the effects achieved by the above-described configuration 1 and the like can be achieved.

MODES FOR CARRYING OUT THE INVENTION

Figure 1:
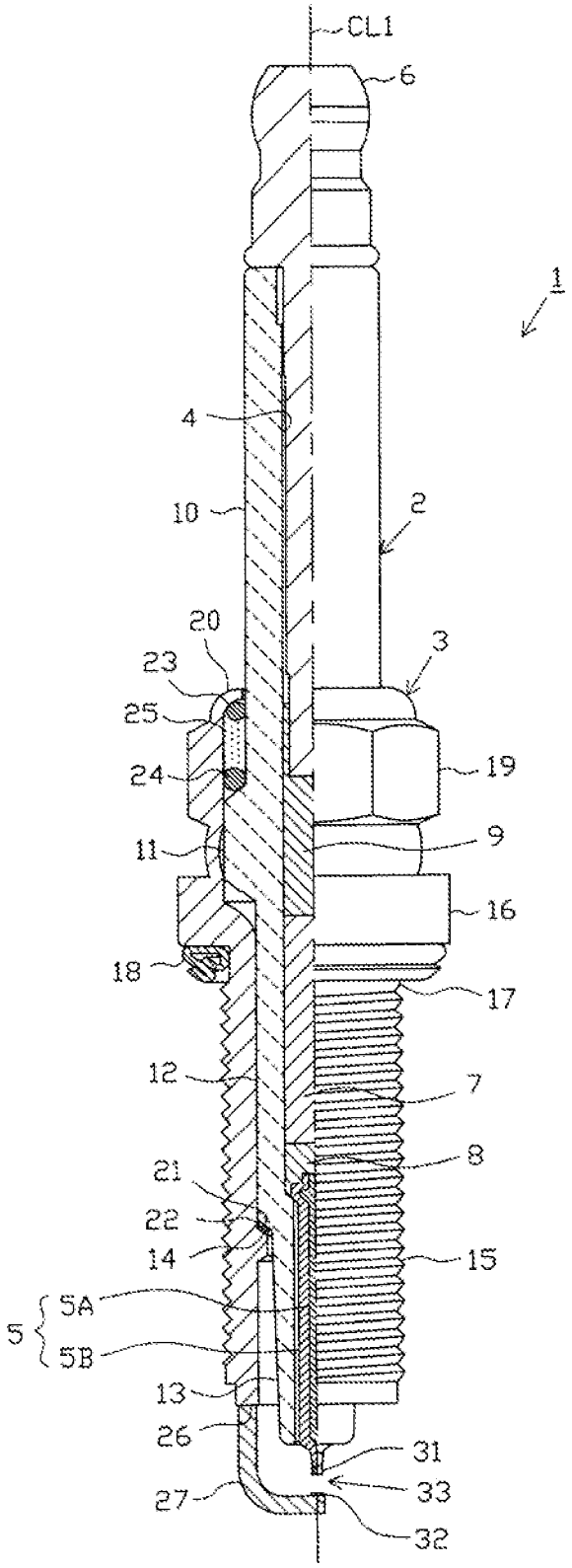
FIG. 1 is a front view with partial cutaway of a spark plug showing the configuration.

Hereinafter, a description of one embodiment will be provided with reference to the drawings. FIG. 1 is a front view with partial cutaway of a spark plug 1. It is to be noted that a description will be provided assuming that the direction of the axial line CL1 of the spark plug 1 is an up/down direction in FIG. 1 where the bottom side of FIG. 1 is a top end side of the spark plug 1 while the top side of FIG. 1 is a rear end side of the spark plug 1.

The spark plug 1 includes a ceramic insulator 2 having a tubular shape, a metal shell 3 having a tubular shape and arranged to hold the ceramic insulator 2, and the like.

The ceramic insulator 2 is formed by firing alumina or the like as is known. The ceramic insulator 2 includes, on the outer portion, a rear-end trunk portion 10 provided on the rear end side, a large-diameter portion 11 provided closer to the top end side than the rear-end body portion 10 and protruding outward in the radial direction, a middle trunk portion 12 provided closer to the top end side than the large-diameter portion 11 and having a smaller diameter than the large-diameter portion 11, and a long leg portion 13 provided closer to the top end side than the middle trunk portion 12 and having a smaller diameter than the middle trunk portion 12. In addition, the large-diameter portion 11, the middle trunk portion 12, and a large portion of the long leg portion 13 in the ceramic insulator 2 are housed inside of the metal shell 3. A tapered step portion 14 is provided at a connecting portion between the middle trunk portion 12 and the long leg portion 13, and the ceramic insulator 2 is locked to the metal shell 3 at the step portion 14.

Further, an axial hole 4 is provided so as to pass through the ceramic insulator 2 along the axial line CL1. A center electrode 5 is inserted into and fixed to the axial hole 4 on the top end side. The center electrode 5 includes an inner layer 5A made from a high thermal conductive metal [e.g., copper, a copper alloy, pure nickel (Ni), and the like], and an outer layer 5B made from an alloy containing Ni as a principal component [it is to be noted that the composition of the center electrode 5 (in particular, the outer layer 5B) will be described in detail later]. Further, the center electrode 5 has a rod shape (cylindrical shape) as a whole. The tip end portion of the center electrode 5 protrudes from the top end of the ceramic insulator 2.

In addition, a terminal electrode 6 is inserted into and fixed to the axial hole 4 on the rear end side while protruding from the rear end of the ceramic insulator 2.

Further, a resistor 7 having a cylindrical shape is provided between the center electrode 5 and the terminal electrode 6 in the axial hole 4. Both the end portions of the resistor 7 are electrically connected to the center electrode 5 and the terminal electrode 6 via conductive glass seals 8, 9.

In addition, the metal shell 3 has a tubular shape and is made from a metal such as low-carbon steel. A threaded portion (male threaded portion) 15 for mounting a the spark plug 1 to a mounting hole of a combustion apparatus (e.g., an internal combustion engine, a fuel battery reforming device, and the like) is provided to the metal shell 3 on the outer peripheral surface. In addition, a bearing surface portion 16 is provided to the metal shell 3 on the outer peripheral surface on the side more rear than the threaded portion 15. A gasket 18 having a ring shape is fitted into a screw neck 17 at the rear end of the threaded portion 15. Further, a tool engaging part 19 having a hexagonal cross section in which a tool such as a wrench is engaged when mounting the metal shell 3 on the above-described combustion apparatus, and a caulking part 20 arranged to hold the ceramic insulator 2 at the rear end portion are provided to the metal shell 3 on the rear end side.

In addition, a tapered step portion 21 arranged to lock the ceramic insulator 2 is provided to the metal shell 3 on the inner peripheral surface. The ceramic insulator 2 is inserted into the metal shell 3 from the rear end side toward the top end side. The ceramic insulator 2 is fixed by caulking the opening on the rear end side of the metal shell 3 inward in the radial direction, that is, by providing the above-described caulking part 20, while the step portion 14 of the ceramic insulator 2 is locked to the step portion 21 of the metal shell 3. It is to be noted that a sheet packing 22 having a ring shape is interposed between the step portions 14, 21. Thus, airtightness in a combustion chamber can be kept, which can prevent a fuel gas from leaking to the outside, the fuel gas entering into the space between the long leg portion 13 of the ceramic insulator 2 and the inner peripheral surface of the metal shell 3 exposed in the combustion chamber.

Further, in order to make the airtightness by caulking more perfect, ring members 23, 24 having a ring shape are interposed between the metal shell 3 and the ceramic insulator 2 on the rear end side of the metal shell 3. A space between the ring members 23, 24 is filled with powder of talc 25. That is, the metal shell 3 holds the ceramic insulator 2 via the sheet packing 22, the ring members 23, 24, and the talc 25.

Figure 2:
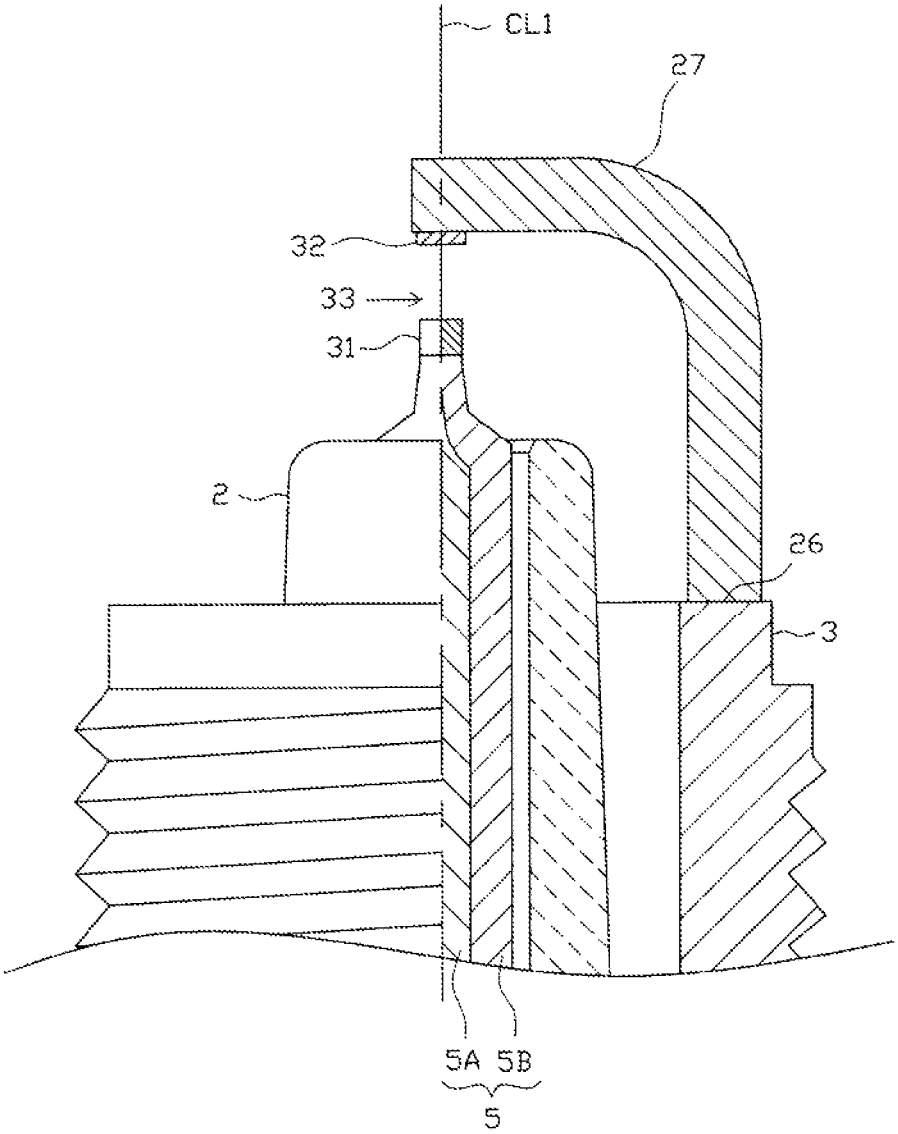
FIG. 2 is a front view with partial cutaway of a tip end portion of the spark plug showing the configuration.

In addition, a ground electrode 27 having a rod shape is bonded to a tip end portion 26 of the metal shell 3, the ground electrode 27 being bent back at the middle part of itself while the side surface on the tip end portion of the ground electrode 27 is opposed to the tip end portion of the center electrode 5 as shown in FIG. 2. In addition, a spark discharge space 33 is provided as a space between the tip end portion of the center electrode 5 and the tip end portion of the ground electrode 27. Thus, spark discharge is generated along the direction of the axial line CL1 in the spark discharge space 33.

In addition, a center electrode-side chip (corresponding to the "chip" according to the present invention) 31 having a cylindrical shape and made from a predetermined metal [e.g., iridium (Ir), platinum (Pt), rhodium (Rh), ruthenium (Ru), rhenium (Re), tungsten (W), palladium (Pd), or an alloy containing at least one of these metals as a principal component] is bonded to a section of the center electrode 5 where the spark discharge space 33 is created with the ground electrode 27 by laser welding, resistance welding, or the like. In addition, a ground electrode-side chip (corresponding to the "chip" according to the present invention) 32 having a cylindrical shape and made from a predetermined metal [e.g., Ir, Pt, Rh, Ru, Re, W, Pd, or an alloy containing at least one of these metals as a principal component] is bonded to a section of the ground electrode 27 where the spark discharge space 33 is created with the center electrode 5 by resistance welding, laser welding, or the like.

Further, in the present embodiment, the center electrode 5 (the outer layer 5B) to which the center electrode-side chip 31 is bonded, and the ground electrode 27 to which the ground electrode-side chip 32 is bonded are made from an electrode material containing Ni as a principal component. To be specific, the electrode material contains Ni as a principal component, 0.50% by mass to less than 1.0% by mass of silicon (Si), 0.2% by mass to 2.0% by mass of aluminum (Al), 12% by mass to 34% by mass of chromium (Cr), 0.03% by mass to 0.2% by mass of at least one element selected from the group consisting of yttrium (Y) and a rare-earth element, more than 0% by mass to 20% by mass of iron (Fe), 0.10% by mass or less of carbon (C), and 1.0% by mass or less of manganese (Mn). Further, the total content of Si and Al is 0.80% by mass or more, and one tenth or less (% by mass) of the content of Cr in the electrode material.

It is to be noted that for the purpose of improving the bondability of the chip 31 (32) to the electrode 5 (27), and the workability and the sulfur resistance of the electrodes 5, 27, the electrode material is preferably such as having the total content of Si and Al of not less than 1.0% by mass, the content of C of not more than 0.05% by mass, the content of Mn of not more than 0.5% by mass, the content of Cr in a range from 18% to 28% by mass, the content of Al of not more than 1.0% by mass, the content of Y in a range from 0.05% to 0.15% by mass, and the content of Fe in a range from 7% to 15% by mass (more preferably, less than 10% by mass).

In addition, examples of the rare-earth element include lanthanum (La), cerium (Ce), neodymium (Nd), samarium (Sm), dysprosium (Dy), erbium (Er), and ytterbium (Yb) in addition to Y.

As described above in detail, according to the present embodiment, in using (under high temperature), $Cr_2O_3$ films excellent in oxidation resistance are sufficiently formed on the surfaces of the electrodes 5, 27, and $Al_2O_3$ films and $SiO_2$ films each of which has a favorable oxidation resistance are surely formed immediately beneath the $Cr_2O_3$ films, which allows the $Cr_2O_3$ films to be held stably by both the films (which can suppress exfoliation of the $Cr_2O_3$ films). This configuration, having the content of Y and the rare-earth element of not less than 0.03% by mass, can also remarkably improve the oxidation resistance of the electrodes 5, 27. As a result, formation of an oxidized scale at a boundary section between the center electrode-side chip 31 and the center electrode 5 and a boundary section between the ground electrode-side chip 32 and the ground electrode 27 can be effectively suppressed.

Further, because the content of Si is less than 1.0% by mass, formation of a eutectic structure with Pt at the above-described boundary sections can be more surely prevented when the chips 31, 32 contain Pt.

In addition, because the electrodes 5, 27 contain Fe, degradation of workability due to strength degradation under high temperature can be improved. In addition, the electrodes 5, 27 are easy to deform at high temperature, so that stress resulting from differential thermal expansion between the chips 31, 32 and the electrodes 5, 27 can be made easily absorbed by the electrodes 5, 27 under high temperature.

In addition, because the content of Al is not more than 2.0% by mass while the content of Fe is not more than 20% by mass, the above-described effect to improve the oxidation resistance of the electrodes 5, 27 can be sufficiently maintained, which can more surely suppress formation of an oxidized scale.

As described above, according to the present embodiment, the above-described effects act synergistically, which can remarkably improve the bondability of the chips 31, 32. As a result, exfoliation (falling) of the chips 31, 32 can be suppressed very effectively.

Further, in the present embodiment, because the content of Al is not more than 2.0% by mass while the content of Cr is not more than 34% by mass, the solution hardening of the electrodes 5, 27 can be more surely prevented. In addition, because the content of Y and the rare-earth element is not more than 0.2% by mass while the content of C is not more than 0.1% by mass, Y, C, and the like can be suppressed from being precipitated under high temperature, which can more surely prevent precipitation hardening of the electrodes 5, 27. As the results, favorable workability can be achieved.

In addition, because the content of Mn is not more than 1.0% by mass, not only formation of MnS but also formation of NiS inside of the electrodes 5, 27 can be effectively suppressed. Thus, the sulfur resistance of the electrodes 5, 27 can be improved, and further improvement can be made with the above-described improvement in oxidation resistance of the electrodes such that the corrosion resistance of the electrodes 5, 27 is remarkably improved.

In addition, if the total content of Si and Al is not less than 1.0% by mass, the $Al_2O_3$ film and the $SiO_2$ film ca be further surely formed immediately beneath the $Cr_2O_3$ film. Thus, exfoliation of the $Cr_2O_3$ film can be more effectively suppressed, and the bondability of the chips 31, 32 can be further improved.

In addition, if the content of C is not more than 0.05% by mass, C can be more effectively suppressed from being precipitated under high temperature. Thus, the precipitation hardening of the electrodes 5, 27 can be prevented more surely, and the workability can be further improved.

Further, if the content of Mn is not more than 0.5% by mass, the sulfur resistance of the electrodes 5, 27 can be further improved. As a result, the corrosion resistance can be further improved.

In addition, if the content of Cr is not less than 18% by mass, oxidation resistance of the electrodes 5, 27 can be more improved. As a result, formation of an oxidized scale at the above-described boundary section can be further suppressed, and the bondability can be further improved.

In addition, if the content of Cr is not more than 28% by mass, the solution hardening of the electrodes 5, 27 can be more surely preveted, and workability can be further improved.

In addition, if the content of Al is not more than 1.0% by mass, AlN can be more surely suppressed from being precipitated. Thus, oxidation resistance of the electrodes 5, 27 can be further improved, and the effect of suppressing formation of an oxidized scale can be further enhanced. In addition, if the content of Al is not more than 1.0% by mass, the solution hardening of the electrodes 5, 27 can be more surely suppressed, and workability can be further improved.

Further, if the content of Y is 0.05% by mass or more, oxidation resistance of the electrodes 5, 27 can be further improved, and thus the bondability of the chips 31, 32 can be further improved.

In addition, if the content of Y is 0.15% by mass or less, Y can be more surely suppressed from being precipitated, so that more excellent workability can be achieved.

In addition, if the content of Fe is 7% by mass or more, hot workability of the electrodes 5, 27 can be more improved, and thermal stress between the chips 31, 32 and the electrodes 5, 27 can be further decreased. As a result, the bondability can be more effectively improved.

Further, if the content of Fe is in a range from 7% to 15% by mass, thermal stress between the chips 31, 32 and the electrodes 5, 27 can be decreased while the solution hardening of the electrodes 5, 27 can be effectively prevented. As a result, the workability can be more improved.

In addition, if the content of Fe is not more than 10% by mass, the oxidation resistance of the electrodes 5, 27 can be further improved, and further excellent bondability can be achieved.

Next, a bondability evaluation test, a workability evaluation test, and a sulfur resistance evaluation test were performed in order to confirm the effects produced by the above-described embodiment.

Figure 3:
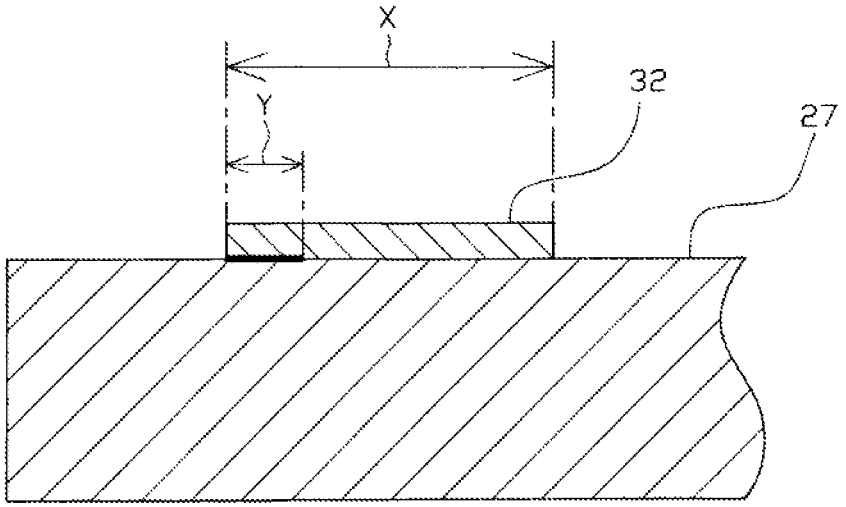
FIGS. 3(*a*) and (*b*) are sectional schematic diagrams for illustrating a calculational procedure of an oxidized scale rate.
Figure 3:
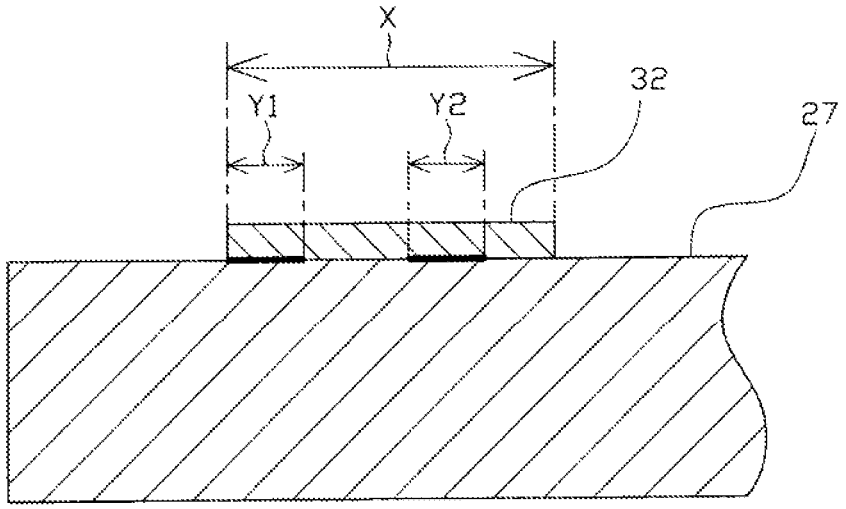

A brief summary of the bondability evaluation test is as follows. To be specific, a plurality of samples of spark plugs were produced by producing ground electrodes from electrode materials that contained Ni as a principal component, Si, Al, Cr, and the like where the contents varied by electrode material, and ground electrode-side chips were resistance-welded to the produced ground electrodes. Next, while heating the samples with the use of a burner for two minutes such that the temperatures of the ground electrodes became 1050° C. and then slowly cooling the samples for one minute was set as one cycle, 1000 cycles were performed. Then, after 1000 cycles were performed, the cross-sections of the ground electrodes were observed. Then, as shown in FIG. 3(*a*), lengths Y of oxidized scales formed at boundary sections between the ground electrodes and the ground electrode-side chips [the sections indicated with thick lines in FIG. 3(*a*)] with respect to lengths X at the boundary sections were measured, and the rates of the lengths Y to the lengths X (oxidized scale rates) were calculated. In this step, the samples having an oxidized scale rate of less than 10% were rated "AAA" as having very excellent bondability. The samples having an oxidized scale rate in a range from 10% to 20% were rated "AA" as having excellent bondability. In addition, the samples having an oxidized scale rate in a range from 20% to 30% were rated "A" as having good bondability. The samples having an oxidized scale in a range from 30% to 40% were rated "B" as having sufficient bondability. Meanwhile, the samples having an oxidized scale rate of 40% or more were rated "F" as having inferior bondability. It is to be noted that when a plurality of oxidized scales were formed, the total of the lengths of the oxidized scales was taken as Y. For example, as shown in FIG. 3(*b*), when a plurality of oxidized scales [the sections indicated with thick lines in FIG. 3(*b*)] were formed, the length Y of the oxidized scale was defined by the total of the oxidized scales (Y1+Y2).

In addition, a brief summary of the workability evaluation test is as follows. To be specific, electrodes having a cylindrical shape (ϕ 5 mm) made from electrode materials that contained Ni as a principal component, Si, Al, Cr, and the like where the contents varied by electrode material were obtained, and an annealing treatment (full annealing treatment) was performed on the obtained electrodes. Next, a tensile test was performed on the electrodes after the annealing treatment. After the test, an elongation between predetermined two points of each electrode was calculated. In this step, the electrodes having an elongation of more than 50% were rated "AA" as having very excellent workability. The electrodes having an elongation in a range from 45% to 50% were rated "A" as having excellent workability. The electrodes having an elongation in a range from 40% to 45% were rated "B" as having good workability. Meanwhile, the electrodes having an elongation of less than 40% were rated "F" as having insufficient workability.

Further, a brief summary of the sulfur resistance evaluation test is as follows. To be specific, a plurality of samples of electrodes made from electrode materials that contained Ni as a principal component, Si, Al, Cr, and the like where the contents varied by electrode material were produced. Each of the samples was buried in $Na_2SO_4$ powder and heated at 900° C. for eight hours. After the heating is performed, the cross-sections of the samples were observed. The maximum thicknesses of MnS formed on the surfaces of the samples were measured. In this step, the samples of which the maximum thickness of MnS was less than 5 μm were rated "AA" as having very excellent sulfur resistance. The samples of which the maximum thickness of MnS was in a range from 5 μm to 10 μm were rated "A" as having excellent sulfur resistance. Meanwhile, the samples of which the maximum thickness of MnS was 10 μm or more were rated "F" as having inferior sulfur resistance.

The test results of the tests are shown in Table 1 and Table 2. It is to be noted that in Sample 28, Nd was selected from the group consisting of Y and the rare-earth element, and 0.03% by mass of Nd was contained in the electrode material. In addition, in Sample 29, La was selected from the above-described group, and 0.03% by mass of La was contained in the electrode material. In Sample 30, Ce was selected from the above-described group, and 0.03% by mass of Ce was contained in the electrode material. Meanwhile, in the samples other than these samples, Y was selected from the above-described group, and Y was contained in the electrode materials.

TABLE 1

| No. | Ni | Cr (% by mass) | Fe (% by mass) | Al (% by mass) | Si (% by mass) | Y (% by mass) | Al + Si (% by mass) | (1/10) × Cr (% by mass) | C (% by mass) | Mn (% by mass) | welding property evaluation | Workability evaluation | Sulfur resistance evaluation |
|---|---|---|---|---|---|---|---|---|---|---|---|---|---|
| 1 | balance | 15 | 5 | 0.6 | 0.2 | 0.04 | 0.8 | 1.5 | 0.10 | 0.6 | F | A | A |
| 2 | balance | 15 | 5 | 0.4 | 0.4 | 0.04 | 0.8 | 1.5 | 0.10 | 0.6 | F | A | A |
| 3 | balance | 15 | 5 | 0.3 | 1.0 | 0.04 | 1.3 | 1.5 | 0.10 | 0.6 | F | A | A |
| 4 | balance | 15 | 5 | 0.4 | 1.0 | 0.04 | 1.4 | 1.5 | 0.10 | 0.6 | F | A | A |
| 5 | balance | 15 | 5 | 0.2 | 1.0 | 0.04 | 1.2 | 1.5 | 0.10 | 0.6 | F | A | A |
| 6 | balance | 15 | 5 | 0.1 | 0.8 | 0.04 | 0.9 | 1.5 | 0.10 | 0.6 | F | A | A |
| 7 | balance | 32 | 5 | 2.5 | 0.6 | 0.04 | 3.1 | 3.2 | 0.10 | 0.6 | F | F | A |
| 8 | balance | 10 | 5 | 0.3 | 0.5 | 0.04 | 0.8 | 1.0 | 0.10 | 0.6 | F | A | A |
| 9 | balance | 35 | 5 | 0.4 | 0.5 | 0.04 | 0.9 | 3.5 | 0.10 | 0.6 | A | F | A |
| 10 | balance | 15 | 5 | 0.4 | 0.5 | 0.01 | 0.9 | 1.5 | 0.10 | 0.6 | F | A | A |
| 11 | balance | 15 | 5 | 0.4 | 0.5 | 0.25 | 0.9 | 1.5 | 0.10 | 0.6 | A | F | A |
| 12 | balance | 15 | 0 | 0.4 | 0.5 | 0.04 | 0.9 | 1.5 | 0.10 | 0.6 | F | A | A |
| 13 | balance | 15 | 25 | 0.4 | 0.5 | 0.04 | 0.9 | 1.5 | 0.10 | 0.6 | F | A | A |
| 14 | balance | 15 | 5 | 0.2 | 0.5 | 0.04 | 0.7 | 1.5 | 0.10 | 0.6 | F | A | A |
| 15 | balance | 15 | 5 | 1.2 | 0.5 | 0.04 | 1.7 | 1.5 | 0.10 | 0.6 | F | A | A |
| 16 | balance | 15 | 5 | 0.4 | 0.5 | 0.04 | 0.9 | 1.5 | 0.20 | 0.6 | B | F | A |
| 17 | balance | 15 | 5 | 0.4 | 0.5 | 0.04 | 0.9 | 1.5 | 0.10 | 1.5 | B | A | F |
| 18 | balance | 15 | 5 | 0.2 | 0.6 | 0.04 | 0.8 | 1.5 | 0.10 | 0.6 | B | A | A |
| 19 | balance | 32 | 5 | 2.0 | 0.6 | 0.04 | 2.6 | 3.2 | 0.10 | 0.6 | A | B | A |
| 20 | balance | 12 | 5 | 0.4 | 0.5 | 0.04 | 0.9 | 1.2 | 0.10 | 0.6 | B | A | A |

TABLE 1-continued

| No. | Ni | Cr (% by mass) | Fe (% by mass) | Al (% by mass) | Si (% by mass) | Y (% by mass) | Al + Si (% by mass) | (1/10) × Cr (% by mass) | C (% by mass) | Mn (% by mass) | welding property evaluation | Workability evaluation | Sulfur resistance evaluation |
|---|---|---|---|---|---|---|---|---|---|---|---|---|---|
| 21 | balance | 30 | 5 | 0.4 | 0.5 | 0.04 | 0.9 | 3.0 | 0.10 | 0.6 | A | B | A |
| 22 | balance | 34 | 5 | 0.4 | 0.5 | 0.04 | 0.9 | 3.4 | 0.10 | 0.6 | A | B | A |
| 23 | balance | 15 | 5 | 0.4 | 0.9 | 0.04 | 1.3 | 1.5 | 0.10 | 0.6 | A | A | A |
| 24 | balance | 15 | 5 | 0.4 | 0.95 | 0.04 | 1.4 | 1.5 | 0.10 | 0.6 | A | A | A |
| 25 | balance | 15 | 5 | 0.4 | 0.5 | 0.03 | 0.9 | 1.5 | 0.10 | 0.6 | B | A | A |
| 26 | balance | 15 | 5 | 0.4 | 0.5 | 0.16 | 0.9 | 1.5 | 0.10 | 0.6 | A | B | A |
| 27 | balance | 15 | 5 | 0.4 | 0.5 | 0.2 | 0.9 | 1.5 | 0.10 | 0.6 | A | B | A |
| 28 | balance | 15 | 5 | 0.4 | 0.5 | 0.03 Nd | 0.9 | 1.5 | 0.10 | 0.6 | B | A | A |
| 29 | balance | 15 | 5 | 0.4 | 0.5 | 0.03 La | 0.9 | 1.5 | 0.10 | 0.6 | B | A | A |
| 30 | balance | 15 | 5 | 0.4 | 0.5 | 0.03 Ce | 0.9 | 1.5 | 0.10 | 0.6 | B | A | A |
| 31 | balance | 15 | 2 | 0.4 | 0.5 | 0.04 | 0.9 | 1.5 | 0.10 | 0.6 | B | A | A |
| 32 | balance | 15 | 16 | 0.4 | 0.5 | 0.04 | 0.9 | 1.5 | 0.10 | 0.6 | B | A | A |
| 33 | balance | 15 | 20 | 0.4 | 0.5 | 0.04 | 0.9 | 1.5 | 0.10 | 0.6 | B | A | A |
| 34 | balance | 15 | 5 | 0.4 | 0.5 | 0.04 | 0.9 | 1.5 | 0.10 | 0.6 | B | A | A |
| 35 | balance | 15 | 5 | 0.4 | 0.5 | 0.04 | 0.9 | 1.5 | 0.10 | 1.0 | B | A | A |

TABLE 2

| No. | Ni | Cr (% by mass) | Fe (% by mass) | Al (% by mass) | Si (% by mass) | Y (% by mass) | Al + Si (% by mass) | (1/10) × Cr (% by mass) | C (% by mass) | Mn (% by mass) | welding property evaluation | Workability evaluation | Sulfur resistance evaluation |
|---|---|---|---|---|---|---|---|---|---|---|---|---|---|
| 36 | balance | 15 | 5 | 0.4 | 0.6 | 0.04 | 1.0 | 1.5 | 0.10 | 0.6 | A | A | A |
| 37 | balance | 15 | 5 | 0.7 | 0.5 | 0.04 | 1.2 | 1.5 | 0.10 | 0.6 | A | A | A |
| 38 | balance | 15 | 5 | 0.4 | 0.5 | 0.04 | 0.4 | 1.5 | 0.05 | 0.6 | B | AA | A |
| 39 | balance | 15 | 5 | 0.4 | 0.5 | 0.04 | 0.9 | 1.5 | 0.02 | 0.6 | B | AA | A |
| 40 | balance | 15 | 5 | 0.4 | 0.5 | 0.04 | 0.9 | 1.5 | 0.10 | 0.5 | B | A | AA |
| 41 | balance | 15 | 5 | 0.4 | 0.5 | 0.04 | 0.9 | 1.5 | 0.10 | 0.3 | B | A | AA |
| 42 | balance | 18 | 5 | 0.4 | 0.5 | 0.04 | 0.9 | 1.8 | 0.10 | 0.6 | A | A | A |
| 43 | balance | 23 | 5 | 0.4 | 0.5 | 0.04 | 0.9 | 2.3 | 0.10 | 0.6 | A | A | A |
| 44 | balance | 28 | 5 | 0.4 | 0.5 | 0.04 | 0.9 | 2.8 | 0.10 | 0.6 | A | A | A |
| 45 | balance | 15 | 5 | 1.0 | 0.5 | 0.04 | 1.5 | 1.5 | 0.10 | 0.6 | A | A | A |
| 46 | balance | 19 | 5 | 1.0 | 0.9 | 0.04 | 1.9 | 1.9 | 0.10 | 0.6 | AA | A | A |
| 47 | balance | 32 | 5 | 1.0 | 0.9 | 0.04 | 1.9 | 3.2 | 0.10 | 0.6 | AA | A | A |
| 48 | balance | 32 | 5 | 1.0 | 0.5 | 0.04 | 1.5 | 3.2 | 0.10 | 0.6 | AA | A | A |
| 49 | balance | 15 | 5 | 0.4 | 0.5 | 0.05 | 0.9 | 1.5 | 0.10 | 0.6 | A | A | A |
| 50 | balance | 15 | 5 | 0.4 | 0.5 | 0.15 | 0.9 | 1.5 | 0.10 | 0.6 | A | A | A |
| 51 | balance | 15 | 7 | 0.4 | 0.5 | 0.04 | 0.9 | 1.5 | 0.10 | 0.6 | A | AA | A |
| 52 | balance | 15 | 10 | 0.4 | 0.5 | 0.04 | 0.9 | 1.5 | 0.10 | 0.6 | A | AA | A |
| 53 | balance | 15 | 15 | 0.4 | 0.5 | 0.04 | 0.9 | 1.5 | 0.10 | 0.6 | B | AA | A |
| 54 | balance | 23 | 10 | 0.5 | 0.8 | 0.10 | 1.3 | 2.3 | 0.03 | 0.0 | AAA | A | AA |
| 55 | balance | 23 | 10 | 0.5 | 0.8 | 0.10 | 1.3 | 2.3 | 0.03 | 0.0 | AAA | A | AA |
| 56 | balance | 23 | 10 | 0.5 | 0.8 | 0.10 | 1.3 | 2.3 | 0.03 | 0.0 | AAA | A | AA |
| 57 | balance | 23 | 10 | 0.5 | 0.8 | 0.10 | 1.3 | 2.3 | 0.03 | 0.0 | AAA | A | AA |

As shown in Table 1 and Table 2, it was found that the samples of which the content of Si was less than 0.50% by mass, or not less than 1.0% by mass (Samples 1 to 5) were inferior in welding property. It is thought that this is because making the content of Si less than 0.50% by mass resulted in insufficient formation of the $SiO_2$ film, and making the content of Si of not less than 1.0% by mass resulted in easy formation of eutectic structures at the boundary sections between the electrodes and the chips.

In addition, it was found that the sample of which the content of Al was less than 0.2% by mass (Sample 6) was inferior in welding property, and the sample of which the content of Al was more than 2.0% by mass (Sample 7) was inferior both in welding property and workability. It is thought that this is because making the content of Al less than 0.2% by mass resulted in insufficient formation of the $Al_2O_3$ film, and making the content of Al more than 2.0% by mass resulted in easy precipitation of AlN on the electrode surfaces under high temperature, which made solution hardening easily occur in the electrodes.

Further, it was found that the sample of which the content of Cr was less than 12% by mass (Sample 8) was inferior in welding property, and the sample of which the content of Cr was more than 34% by mass (Sample 9) was inferior in workability. It is thought that this is because making the content of Cr less than 12% by mass resulted in insufficient formation of the $Cr_2O_3$ film on the electrode surface, and making the content of Cr more than 34% by mass made solution hardening easily occur in the electrode.

In addition, it was found that the sample of which the content of at least one element selected from the group consisting of Y and the rare-earth element (hereinafter, referred to as "the rare-earth element or the like") (Sample 10) was less than 0.03% by mass was inferior in welding property, and the sample of which the content of the rare-earth element or the like was more than 0.2% by mass (Sample 11) was inferior in workability. It is thought that this is because making the content of the rare-earth element or the like less than 0.03% by mass resulted in reduction in high-temperature oxidation resistance of the electrode, and making the content of the rare-earth element or the like more than 0.2% by mass made solution hardening easily occur in the electrode.

In addition, it was found that the sample of which the content of Fe was 0% by mass (Sample 12) and the sample of which the content of Fe was more than 20% by mass (Sample 13) were inferior in welding property. It is thought that this is because making the content of Fe 0% by mass resulted in difficult deformation of the electrode by hot working, so that the thermal stress between the electrode and the chip is increased under high temperature. In addition, it is thought that this is because making the content of Fe more than 20% by mass resulted in easy oxidation of the electrode.

Further, it was found that the sample of which the total content of Al and Si (Al+Si) was less than 0.8% by mass (Sample 14) was inferior in welding property. It is thought that this is because an oxidized film of Al and Si was not sufficiently formed, which resulted in easy oxidation of the electrode.

In addition, it was found that the sample of which the total content of Al and Si (Al+Si) was more than one tenth of the content of Cr (Sample 15) was inferior in welding property. It is thought that this is because the state that an $SiO_2$ film and an $Al_2O_3$ film were located immediately beneath the $Cr_2O_3$ film on the electrode surface was not easily brought, which resulted in easy exfoliation of the $Cr_2O_3$ film.

In addition, it was found that the sample of which the content of C was more than 0.10% by mass (Sample 16) was inferior in workability. It is thought that this is because solution hardening becomes more likely to occur in the electrode.

Further, it was found that in the sample of which the content of Mn was more than 1.0% by mass (Sample 17), MnS was easily formed inside the electrode, so that sample was inferior in sulfur resistance.

In contrast, it was found that the samples having the content of Si in a range from 0.50% to 1.0% by mass, that of Al in a range from 0.2% to 2.0% by mass, that of Cr in a range from 12% to 34% by mass, that of the rare-earth element or the like in a range from 0.03% to 0.2% by mass, that of Fe being more than 0% but not more than 20% by mass, that of C of not more than 0.10% by mass, and that of Mn of not more than 1.0% by mass, wherein the total content of Si and Al is not less than 0.80% by mass, and less than one tenth of the content of Cr (Samples 18 to 57) shows favorable performance in each of welding property, workability, and sulfur resistance.

In addition, the samples of which only the total contents of Al and Si were varied (Samples 34, 36, and 37) were compared. As a result of the comparison, it was found that especially the samples of which the total content of Al and Si was not less than 1.0% by mass (Samples 36 and 37) had more favorable welding property.

Further, the samples of which only the contents of C were varied (Samples 34, 38, and 39) were compared. As a result of the comparison, it was found that the samples of which the content of C was not more than 0.05% by mass (Samples 38 and 39) were more excellent in workability.

In addition, the samples of which only the contents of Mn were varied (Samples 34, 40, and 41) were compared. As a result of the comparison, it was found that the samples of which the content of Mn was not more than 0.5% by mass (Samples 40 and 41) shows more favorable sulfur resistance.

In addition, the samples of which only the contents of Cr were varied (Samples 21, 22, 34, and 42 to 44) were compared. As a result of the comparison, it was found that the samples of which the content of Cr was not less than 18% by mass (Samples 21, 22, and 42 to 44) had more improved welding property. Further, it was found that the samples of which the content of Cr was not more than 28% by mass (Samples 34, 42 to 44) were more excellent in workability.

In addition, the samples of which only the content of Al were varied (Samples 19, 47, and 48) were compared. As a result of the comparison, it was found that the samples of which the content of Al was not more than 1.0% by mass (Samples 47, 48) were more improved both in welding property and workability.

In addition, the samples of which only the contents of Y were varied (Samples 26, 34, 49, and 50) were compared. As a result of the comparison, it was found that making the content of Y to be not less than 0.05% by mass could further improve the welding property. Further, it was found that making the content of Y to be not more than 0.15% by mass could further improve workability.

In addition, the samples of which only the contents of Fe were varied (Samples 32 to 34, and 51 to 53) are compared. As a result of the comparison, it is found that the samples of which the content of Fe is in a range from 7% to 15% by mass are more improved in workability. In addition, as a result of the comparison of Samples 51 to 53, it was found that making the content of Fe of not more than 10% by mass could achieve more favorable welding property.

According to the above-described test results, for achieving favorable performance in each of welding property, workability, and sulfur resistance, it is preferable that the electrode material should be made in a way such as having the content of Si in a range from 0.50% to 1.0% by mass, that of Al in a range from 0.2% to 2.0% by mass, that of Cr in a range from 12% to 34% by mass, that of the rare-earth element or the like in a range from 0.03% to 0.2% by mass, that of Fe being more than 0% but not more than 20% by mass, that of C of not more than 0.10% by mass, and that of Mn of not more than 1.0% by mass, wherein the total content of Si and Al is not less than 0.80% by mass, and less than one tenth of the content of Cr.

In addition, from the viewpoint of more improving the welding property, it is more preferable that the total content of Al and Si should be not less than 1.0% by mass.

In addition, it is further preferable that the content of C should be not more than 0.05% by mass, or the content of Fe should be in a range from 7% to 15% by mass in order to more improve the workability. It is more preferable that the content of Fe should be not more than 10% by mass from the viewpoint of also improving the welding property together.

Further, from the viewpoint of more improving both the welding property and workability, it is more preferable that the content of Cr should be in a range from 18% to 28% by mass, that the content of Al should be not more than 1.0% by mass, or that the content of Y should be in a range from 0.05% to 0.15% by mass.

It is to be noted that the present invention is not limited to the descriptions of the above-described embodiment, and it is also possible to perform as follows. It is sure that other application examples and modified examples that are not exemplified in the following description are possible.

(a) While the chips 31, 32 are provided to both of the center electrode 5 and the ground electrode 27 in the above-described embodiment, one of the chips 31, 32 may be omitted. It is to be noted that in this case, it is essential only that only at least the electrode to which the chip is provided should be made from the above-described electrode material.

(b) While the ground electrode 27 is made from a single metal in the above-described embodiment, it is also possible to provide an inner layer made from a high thermal conductive metal (e.g., copper, a copper alloy, pure nickel (Ni), and the like) inside of the ground electrode 27 to provide the ground electrode 27 with a multi-layer structure including an outer layer and an inner layer. It is to be noted that in this case, it is essential only that the section of the ground electrode 27 (the outer layer) that is bonded to the ground electrode-side chip 32 should be made from the above-described electrode material.

(c) While embodied in the above-described embodiment is a case where the ground electrode 27 is bonded to tip end portion 26 of the metal shell 3, it is also possible to form a ground electrode so as to scrape off a portion of a metal shell (or a portion of a tip-end metal shell preliminarily welded to the metal shell) (e.g., JP-A-2006-236906).

(d) While the tool engaging part 19 has a hexagonal cross section in the above-described embodiment, the shape of the tool engaging part 19 is not limited to this shape. For example, the tool engaging part 19 may have a Bi-HEX (deformed dodecagon) shape [ISO22977: 2005 (E)] or the like.

The present invention has been described in detail with reference to the specific embodiment; however, it is obvious to those skilled in the art that various changes and modifications can be made without departing from the spirit and scope of the present invention.

The present application is based on the Japanese Patent Application filed on Jan. 8, 2013 (No. 2013-000885), and the contents thereof are incorporated herein by reference.

INDUSTRIAL APPLICABILITY

The electrode material according to the present invention is capable of remarkably improving the bondability between the electrode and the chip to avoid exfoliation of the chip very effectively, by which durability of a spark plug including the electrode to which the chip is bonded can be greatly improved.

DESCRIPTION OF REFERENCE NUMERALS AND SIGNS

1 . . . Spark plug, 5 . . . Center electrode, 27 . . . Ground electrode, 31 . . . Center electrode-side chip (Chip), 32 . . . Ground electrode-side chip (Chip), 33 . . . Spark discharge space (Space)

The invention claimed is:

1. An electrode material for an electrode that is provided with a chip and is for use in a spark plug, the spark plug comprising a center electrode and a ground electrode creating a space with the center electrode, the chip being provided to at least one of the electrodes, the electrode material comprising (A) nickel as a principal component, and further including:

(B) silicon of which content in a range from 0.50% to 1.0% by mass, (C) aluminum of which content in a range from 0.2% to 2.0% by mass, (D) chromium of which content in a range from 12% to 34% by mass, (E) iron of which content is more than 0% to 20% by mass, (F) carbon of which content is not more than 0.10% by mass, (G) manganese of which content is not more than 1.0% by mass, and (H) at least one element selected from the group consisting of yttrium and a rare-earth element of which content in a range from 0.03% to 0.2% by mass, wherein a total content of silicon and aluminum is not less than 0.80% by mass and is one tenth or less of the content of chromium.

2. The electrode material according to claim 1, wherein the total content of silicon and aluminum is not less than 1.0% by mass.

3. The electrode material according to claim 1, wherein the content of carbon is not more than 0.05% by mass, and wherein the content of manganese is not more than 0.5% by mass.

4. The electrode material according to claim 1, wherein the content of chromium is in a range from 18% to 28% by mass.

5. The electrode material according to claim 1, wherein the content of aluminum is not more than 1.0% by mass.

6. The electrode material according to claim 1, wherein the content of yttrium is in a range from 0.05% to 0.15% by mass.

7. The electrode material according to claim 1, wherein the content of iron is in a range from 7% to 15% by mass.

8. The electrode material according to claim 1, wherein the content of iron is not more than 10% by mass.

9. A spark plug comprising:

an insulator having a through-hole in a direction of an axial line;

a center electrode disposed at a tip end portion of the insulator;

a metal shell disposed on an outer periphery of the center electrode; and a ground electrode bonded to a tip end portion of the metal shell, wherein at least one of the center electrode and the ground electrode is made from the electrode material according to claim 1, and is bonded to a chip.

10. The electrode material according to claim 1, wherein the content of silicon is in a range from 0.8% to 1.0% by mass.

* * * * *